US008016118B2

(12) United States Patent
Boll

(10) Patent No.: US 8,016,118 B2
(45) Date of Patent: Sep. 13, 2011

(54) DIGGER SIFTER WITH ERGONOMIC HANDLE

(76) Inventor: Charles Arthur Boll, Portsmouth, VA (US)

( * ) Notice: Subject to any disclaimer, the term of this patent is extended or adjusted under 35 U.S.C. 154(b) by 366 days.

(21) Appl. No.: 12/322,308

(22) Filed: Jan. 31, 2009

(65) Prior Publication Data

US 2010/0193410 A1 Aug. 5, 2010

(51) Int. Cl.
*B07B 1/49* (2006.01)

(52) U.S. Cl. ..... 209/417; 209/418; 209/419

(58) Field of Classification Search ..... 209/417, 209/418, 419

See application file for complete search history.

(56) References Cited

U.S. PATENT DOCUMENTS

| | | | | | |
|---|---|---|---|---|---|
| 3,942,831 | A * | 3/1976 | Sosnove | 294/1.4 |
| 4,822,087 | A * | 4/1989 | DeCarlo | 294/1.1 |
| 4,828,690 | A * | 5/1989 | Montez | 209/418 |
| 5,529,357 | A * | 6/1996 | Hoffman | 294/58 |
| 5,716,087 | A * | 2/1998 | Backich et al. | 294/55 |
| 5,771,910 | A * | 6/1998 | Kluttz | 135/68 |
| 5,890,259 | A * | 4/1999 | Sarac | 16/422 |
| 5,921,596 | A * | 7/1999 | Sheriff et al. | 294/1.4 |
| 6,003,913 | A * | 12/1999 | Flumiani | 294/1.4 |
| 6,050,626 | A * | 4/2000 | Dudley | 294/61 |
| D427,392 | S * | 6/2000 | Mousser | D30/162 |
| 6,082,759 | A * | 7/2000 | Faigle et al. | 280/728.3 |
| D437,462 | S * | 2/2001 | Whall et al. | D30/162 |
| 6,209,729 | B1 * | 4/2001 | Brouillard | 210/470 |
| D520,819 | S * | 5/2006 | Onembo | D8/10 |
| 2004/0124646 | A1 * | 7/2004 | Peko | 294/1.4 |
| 2004/0164568 | A1 * | 8/2004 | Diehl | 294/1.4 |
| 2004/0189027 | A1 * | 9/2004 | Warn et al. | 294/1.4 |
| 2005/0218044 | A1 * | 10/2005 | Bramante | 209/417 |
| 2006/0174449 | A1 * | 8/2006 | Hughes | 16/430 |
| 2006/0175849 | A1 * | 8/2006 | Warn et al. | 294/1.4 |

FOREIGN PATENT DOCUMENTS

WO WO 9117647 A1 * 11/1991

* cited by examiner

*Primary Examiner* — Terrell Matthews
(74) *Attorney, Agent, or Firm* — Bradley D. Goldizen

(57) ABSTRACT

A sifter device includes a proximal end having an arm support ring through which a user's hand and lower arm passes. A pair of elongated arms is arranged on opposite sides of the arm ring. A basket scoop, having a cutting edge, is arranged at a distal end of the device for scooping a medium that contains a detected metallic object that is retrieved. A grip is arranged along the pair of elongated member and includes an end that extends beyond the elongated members to be used in hanging the device from an article of clothing during metal detecting search activities when not digging or sifting in the medium. For example, an operator's belt or pants pocket may be used to hang the device from an article of clothing when not in use, preferably on the back pocket out of the way of the magnetic field generated by the metal detector.

20 Claims, 9 Drawing Sheets

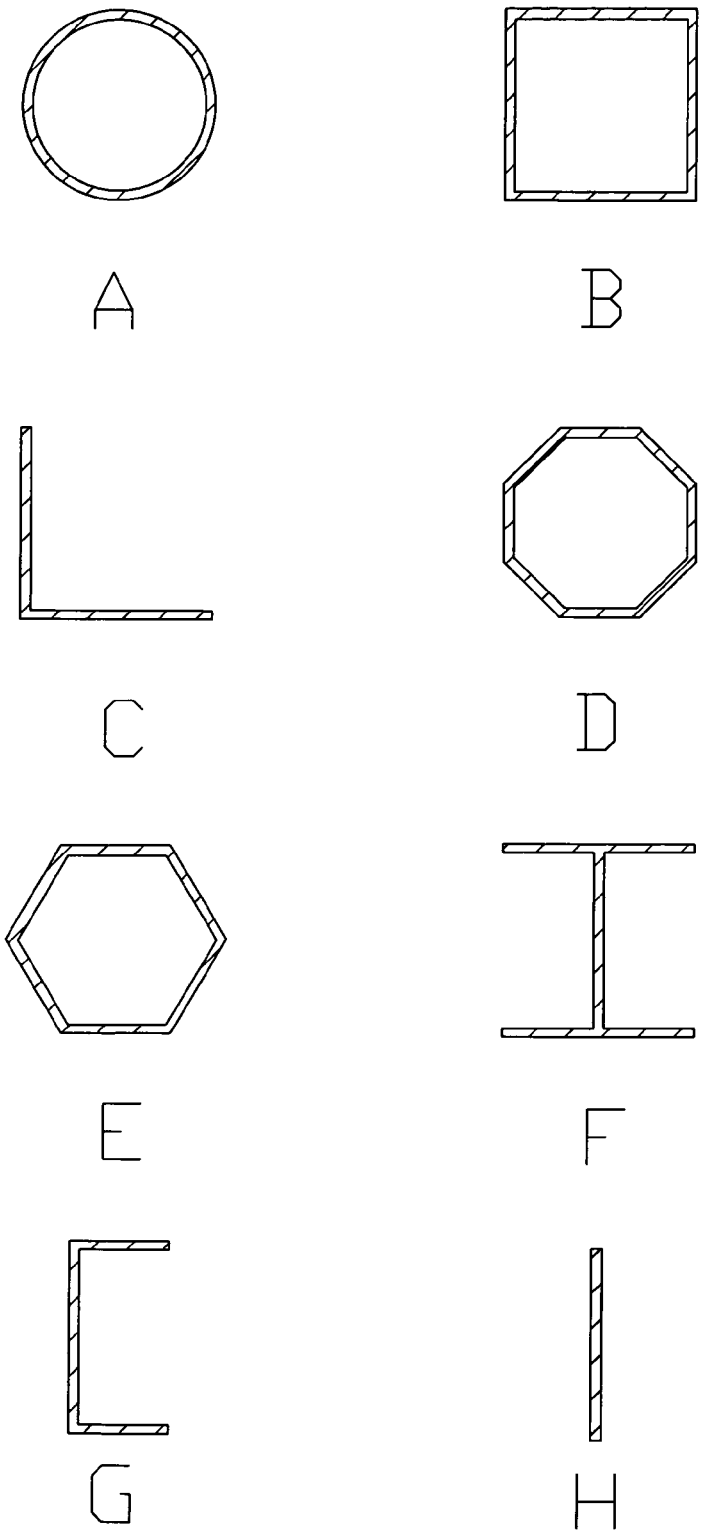
Fig. 4A-H

DIGGER SIFTER WITH ERGONOMIC HANDLE

There are no related patent applications.

The subject matter of the present invention did not receive federal government research and development funding.

TECHNICAL FIELD

The present invention generally relates to an apparatus, device for locating and separating objects from a medium in which such objects are disposed and for use in conjunction with a metal detector. In particular, the present invention relates to a device that allows a user to scoop and simultaneously sift a medium with one hand and forearm making it an ergonomic handle. Otherwise, the device may be hung from an article of clothing such as when not being used to sift through the medium.

BACKGROUND OF THE INVENTION

There is an increasing trend in the number of people becoming interested in amateur prospecting, treasuring hunting, metal detecting, amateur geology, and amateur archaeology. A metal detector may be used to pursue these various activities by identifying metallic objects arranged within the surface of the earth. In many instances, these activities may take place in beach sand. During these "beachcombing" operations, a user walks along a beach carrying a metal detector. A distal end of the metal detector includes a sensor coil. A proximal end includes a grip and/or arm support with control electronics, a power source and an indicator means. The indicator means alerts the user when the sensor coil passes across or in near proximity to a metallic object.

The inventor, Mr. Charles A. Boll, has attempted, through trial and error, to arrive at a suitable apparatus which could be used both for digging, scooping and for sifting metallic objects from sand and other dirt taken from the earth. Thus, the device is known as a digger sifter with ergonomic handle. The prior art fails to satisfy the inventor's needs and possesses numerous disadvantages over the present invention. Typically, the prior art devices cannot be easily carried or suspended in a hand-free manner on the user when not in use. Many prior art devices require two-handed operations when scooping and sifting for hidden or lost items. Moreover, many cannot be used when standing upright to dig and sift to prevent a user's back and/or knees from becoming sore from bending over excessively during metal detecting operations. Otherwise, they do not comprise an ergonomic handle as claimed in the present invention. Still others require a user to step on a rear of the device or the metal detector and scoop are included as a single heavy device requiring all its weight to be carried on a single arm of the user. For example, see U.S. Pat. No. 4,983,281 to Montelione.

Prior devices in the sifting field are exemplified by U.S. Pat. No. 3,976,564 to Holder; U.S. Pat. No. 645,956 to Hyrons; U.S. Pat. No. 657,508 to W. W. Brown; U.S. Pat. No. 681,608 to O. P. Baughman; U.S. Pat. No. 2,005,416 to J. H. Fisher; U.S. Pat. No. 4,983,281 to Montelione; U.S. Pat. No. 4,979,623 to Flanagan; U.S. Pat. No. 4,359,686 to Wherry; U.S. Des. Pat. No. 339,966 to Burnett; and.

SUMMARY OF THE INVENTION

The present invention provides an apparatus for manually scooping and separating objects from a medium in which such objects are disposed. The apparatus includes means for temporarily scooping a portion of said medium which may contain one or more of said objects, and means for sifting said medium so as to separate said objects from said medium while discarding the sifted medium.

In one instance, the present digger sifter with ergonomic handle is easy on the wrist of the operator by means of two locations of body contact. That is, a user passes his arm through a ring or arm sleeve part 5 while gripping a handle 8 arranged horizontal to the ground whereas the prior art does not. The use of two body contacts produces a multiplier effect of by allowing the user to use a larger group of muscles which are stronger than those in the wrist. This effect creates a mechanical advantage that requires minimal movement of the operator's arm to operate the scoop member 20. A notch 9 is provided on arm 8 to keep the scoop sifter out of the magnetic field of the metal detector when carrying it or during detection operations. This allows the user to rest the arm muscles until it is used to scoop another object of interest. Two elongated arms provide a support structure for accepting a wide variety of scoops. The scoop 20 may comprise different materials and include various methods of attaching it to the elongated arm members. Bolts, rivets, various threaded shafts, nuts, washers, pins, or any other such fasteners may couple the scoop 20 to the elongated arms. Thus, the tool may be light in weight.

Moreover, usage of the tool is easier than prior art ones that require the weight of the user be applied to the rear of the tool. Such prior art devices require a balancing act during use in the ocean surf. The user must hold the metal detector in one hand and the prior art sifting device in the other while attempting to apply the user's weight onto the back of the tool. The user's movements are further hindered by ocean waves which continually shift the sand from underneath the user's feet. Thus, the present invention makes the sport of treasure hunting more attractive with both feet on the ground to opperate.

The novel arrangement of parts in the present invention may comprise 25 gauge galvanized hardware cloth having a cross sectional diameter of an individual wire being measured at 0.04" or 18 gauge thick wire. These sizes are beneficial in passing a medium through the substantially rigid sifter basket 25. In a preferred embodiment, the range of the aperture-to-total area ration of the mesh material is about 84% which is not found in the prior art. This ratio allows for easy use of the instant invention in both dry and wet sand as well as in shallow water or during scuba diving.

The pitched angle of the scoop relative to the parallel elongated arms may be varied by including adjustment openings 22 in the sides of the scoop near where the elongated arms attach. By increasing the pitch of the scoop relative to the horizontal, provides for more aggressive digging to allow more medium into the scoop.

In some embodiments of the invention, a longer basket 25 increases the surface area and makes it easier to pass medium through the basket 25. The larger sized basket is useful in hard packed wet sand. Other embodiments include oval shaped or rectangular shaped scoops that are over sized and which facilitate the faster removal of medium through the larger basket. In one embodiment, a plastic oval shaped scoop and oval shaped scoop with V-bottom, 14 gauge galvanized steel that is 1¼ inch wide strap of sheet metal is mounted to the front of the scoop to create a blade which reduces wear and abrading of the forward edge of the scoop member.

The present tool is used by pulling the scoop from 2 to 8 o'clock with the operator's feet arranged at 7 and 5 o'clock. The scoop is pulled towards the operator to capture medium. Thereafter, the scoop is shaken back and forth to sift medium through the scoop 20 and basket 25. By twisting the arm and wrist left and right, the rear tip speed of the basket is increased.

The present invention, as described herein, is particularly well suited for use, in conjunction with a portable metal detector, to locate and separate objects from sand, principally beach sand. It will be appreciated by those skilled in the art, however, that the present invention may be used for locating and separating other types of objects from various other media. Thus, the phraseology and terminology "objects" as used hereinafter in this context is intended to include and embrace anything which is perceptible by one or more of the senses, especially something that can be seen and felt, and is not limited or restricted to metallic items. Furthermore, the terminology and phraseology "medium" as used hereinafter in this context is intended to connote generally any surrounding or pervading substance in which bodies or objects exist or move, and includes, but is not limited to, sand, earth, water, dirt, mud, gravel, etc.

A digger sifter with ergonomic handle comprises an arm and hand supported elongated handle assembly including a pair of elongated arms. The elongated arm handle assembly includes a proximal end and a distal end. An arm ring attaches at the proximal end of the arm supported elongated handle assembly. The operator passes his hand and a portion of his arm through the arm ring such that the proximal end of the elongated handle assembly is constrained by a portion of the operator's arm. A scoop, having an opening that is arranged against a wire basket, has a cutting edge that cuts into the medium to be sifted. The opening is adapted to accept the medium having an object arranged therein. The scoop and wire basket attaches to the distal end of the arm supported elongated handle assembly. A cross brace attaches to the pair of parallel elongated arms intermediate the proximal and distal end of the arm and hand supported elongated handle assembly for providing a surface which may be gripped by the user of the digger sifter. One end of the cross brace extends outward from an elongated arm and includes a notch adapted to attach the sifter to an operator's belt or pants pocket when not in use, preferably on the back pocket out of the way when using a metal detector as shown in FIGS. 3A-3B. A stirrup-shaped grip fastens to the cross member or the D-stirrup can be omitted and a filler piece can be added to the cross brace with appendages.

An arm and hand supported elongated ergonomic handle assembly comprises a pair of parallel elongated arms. Each parallel elongated arm includes a proximal end and a distal end. A circular arm ring attaches between the proximal ends of the pair of parallel elongated arms. A scoop, including a front edge with a cutting edge, is arranged between the distal ends of the pair of parallel elongated arms and having an opening. The cutting edge of the scoop is preferably arranged along a bottom front edge of the scoop such that it bites into a medium having an object of interest. A sifter is arranged against a rear or back side of the scoop opposite the cutting edge. The sifter accepts and sifts media that has been cut by the cutting member and passed into the scoop. The media preferably includes an object of interest which is filtered from the media during the scooping and sifting process. A b-shaped hand grip attaches to the pair of parallel elongated members intermediate the scoop sifter assembly and the circular arm ring. One end of the b-shaped hand grip extends past the exterior edge of one of the elongated members and includes a notch that is adapted to attach the digger sifter with ergonomic handle to an operator's belt, waistline or pants pocket. That is, the invention attaches to an operator's belt or pant's pocket when not in use, preferably on the back pocket out of the way when using a metal detector as shown in FIGS. 3A-3B.

One of the principal objects of the present invention is to provide a lightweight and convenient apparatus for use in conjunction with a metal detector which will allow the user to scoop and sift simultaneously with one hand. Another object of the present invention is to provide an apparatus or device for locating and separating objects from a medium in which such objects are disposed and having an ergonomic handle.

It is an additional object of the invention to provide a device of the character described that can be operationally used to scoop and sift dry, as well as hard packed wet sand located at an edge of a body of water. The apparatus is also particularly useful underwater, in shallow water, and deep water during scuba diving operations.

It is a further object of the present invention to provide an embodiment of the present invention that can be readily supported from an operator's clothing when not in use.

It is another object to provide a sorting and sifting device in which lateral and rotational stability between the operator and the scooping mechanism is provided to the device by a pair of transversely spaced-apart elongated arm members.

It is another object to provide a device in which such laterally spaced apart elongated arms can be attached to scoop members constructed of varying materials and having varying sizes and geometries.

These and other objects of the invention and advantages of the invention will be set forth, appear in part or become apparent after considering the specification, accompanying drawings, and appended claims. It is to be realized that the following embodiments of the invention have been represented in their simplest form for ease in understanding the invention.

BRIEF DESCRIPTION OF THE DRAWINGS

The invention will be better understood and objects other than those set forth above will become apparent when consideration is given to the following detailed description thereof. Such description makes reference to the annexed drawings.

FIGS. 4A through 4H show various geometric cross sections of a parallel elongated member.

DETAILED DESCRIPTION OF THE INVENTION

Figure 1A:
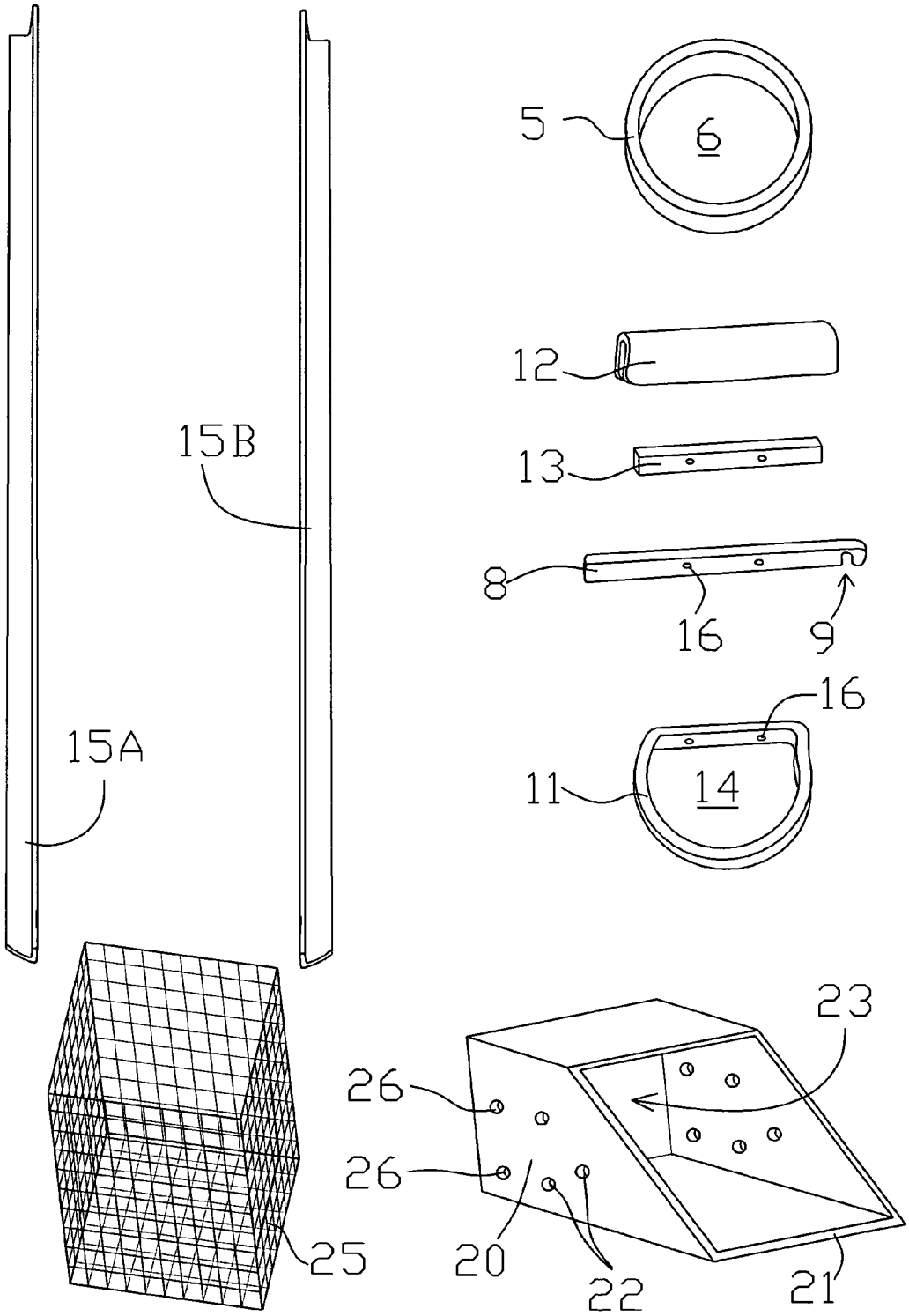
FIG. 1A is an exploded view of the various pieces necessary for practicing an embodiment of the invention. It should be noted that fasteners which fix the various parts are not shown in this view. Fasteners may include, but not be limited to screws, bolts, nuts, washers, threaded rods, clips, rivets or any mechanism which fastens one part of the various pieces to another.

The embodiments of the invention and the various features and advantageous details thereof are more fully explained with reference to the non-limiting embodiments and examples that are described and/or illustrated in the accompanying drawings and set forth in the following description. It should be noted that the features illustrated in the drawings are not necessarily drawn to scale, and the features of one embodiment may be employed with the other embodiments as the skilled artisan recognizes, even if not explicitly stated herein. Descriptions of well-known components and techniques may be omitted to avoid obscuring the invention. The examples used herein are intended merely to facilitate an understanding of ways in which the invention may be practiced and to further enable those skilled in the art to practice the invention. Accordingly, the examples and embodiments set forth herein should not be construed as limiting the scope of the invention, which is defined by the appended claims. Moreover, it is noted that like reference numerals represent similar parts throughout the several views of the drawings.

Before explaining the present invention in detail, it should be understood that the present invention is not limited in its application or construction to the details of the arrangement of parts and construction illustrated in the accompanying drawings, because the present invention is capable of other embodiments and modifications and of being practiced or carried out in various ways. Furthermore, it should also be understood that phraseology or terminology employed herein is for the purpose of description and illustration only, and not of limitation or restriction.

With reference to the drawings, there is illustrated an apparatus 1 according to a preferred embodiment of the present invention. The novel apparatus 1 is especially useful for scooping and separating objects, such as metal coins, jewelry, mollusks, or other objects, from a medium, such as sand, in which such objects may be disposed.

The apparatus 1, which is adapted to be supported from an operator's arm and hand during use, includes an elongate handle assembly 15 that extends between an arm ring 5 at the handle assembly's proximal end and a scoop member 20 at the handle assembly's distal end. The apparatus 1 may be formed from a group of materials consisting of aluminum, galvanized steel, copper, stainless steel, plastics, fiberglass, thermoplastic, polycarbonate, wood, steel, or a combination thereof.

The handle assembly 15 comprises a pair of elongated arms 15A, 15B. The elongated arms 15A, 15B are oriented parallel to each other, and together define "handle plane" (P). In order to provide a clear description of the present invention, the nominal orientation of the apparatus, and of various components of the invention, is described relative to a vertical plane (V) or a horizontal plane (H) which are respectively orientated with respect to the handle plane P. It should be understood, however, that such spatial descriptors should not be construed as restricting operational movement or orientation of the assembled apparatus 1.

An arm ring 5 is provided at the proximal end of the handle assembly 15, and is attached to the elongated arms at substantially diametrically opposite sides of the arm ring 5. The arm ring 5 is preferably a closed, circular shape and has an inside diameter 6 that is large enough to allow an operator to insert his/her forearm through it. In a preferred embodiment of the invention, the arm ring is made of PVC plastic, is between 1 and 1-½ inches long when measured in the axial direction, has an inside diameter of 4 inches, and is approximately ¼ inch thick. The arm ring can be advantageously manufactured from 4-inch PVC pipe. In modified embodiments of the invention, the arm ring can have a smaller or larger diameter, so as to be wearable by children or larger persons, respectively. The edges of the arm ring are preferably curved, so as to minimize pressure against the operator's arm. The edges may be formed in a curved manner or created by turning them with a ⅛" round router bit and in modified embodiments made of aluminum, galvanized steel, plastics, fiberglass, copper, stainless steel, polycarbonates, wood, steel or metal alloys.

The arm ring 5 includes openings and is attached to elongated members by fasteners 50. In the preferred embodiment of the invention, the fasteners are rivets, but other conventional fasteners, including screws, bolts, welding, bonding or clips or the like can alternatively be used. Likewise, if the device is formed by metallic materials, welding, brazing or the like may be utilized to secure the various parts to implement the invention.

Figure 2A:
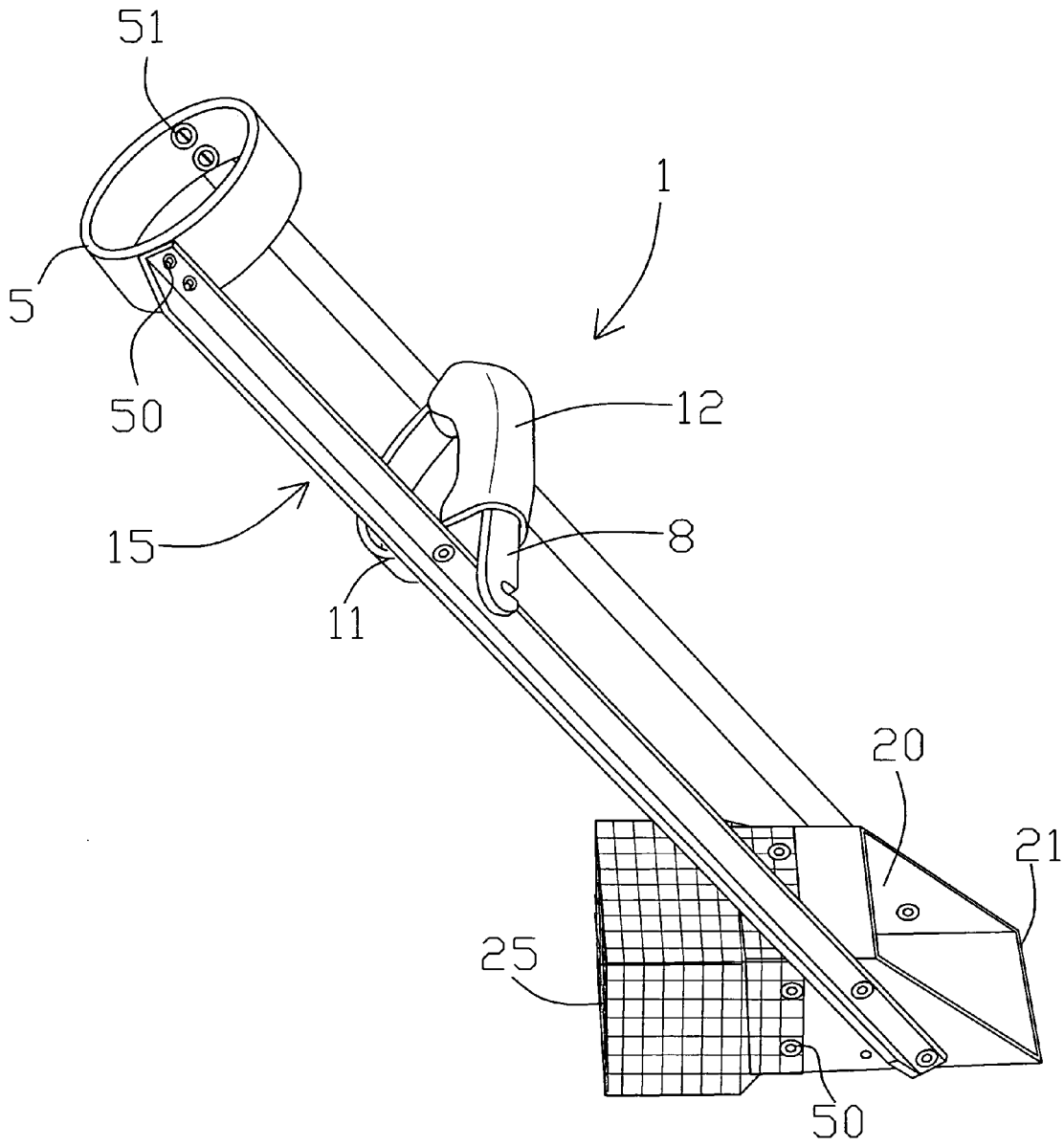
FIG. 2A is a first embodiment of the invention having I-shaped parallel elongated arms. A square scoop having an angled front cutting edge is arranged at a distal end of the parallel elongated arms.
Figure 2B:
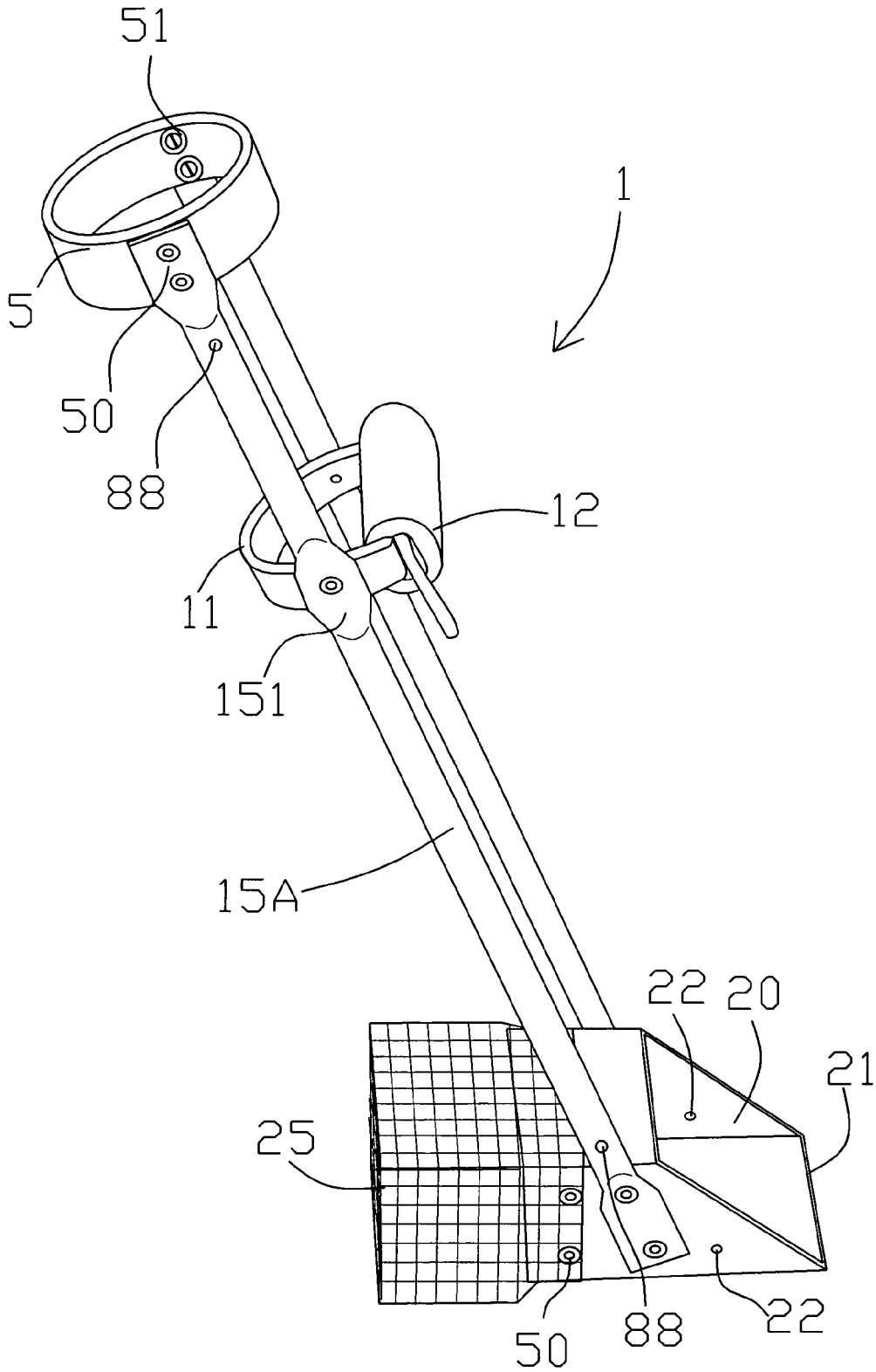
FIG. 2B is a second embodiment of the invention having parallel elongated arms formed from cylindrical tubing with flattened regions for accepting fasteners that couple the various elements of the apparatus thereto.
Figure 2C:
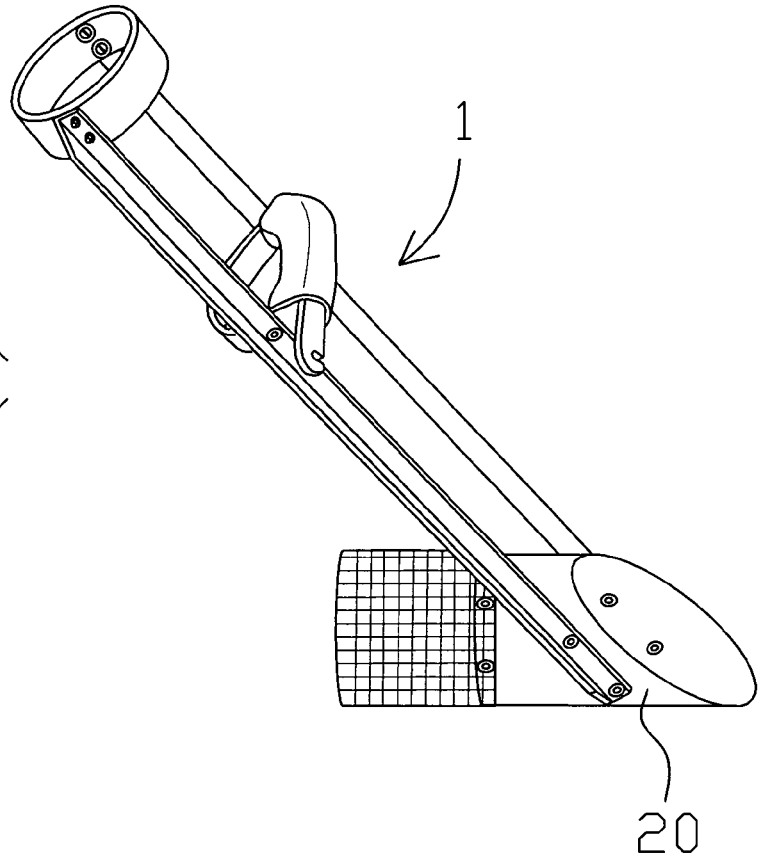
FIG. 2C is a third embodiment of the invention having a modified scoop member that is round.
Figure 2D:
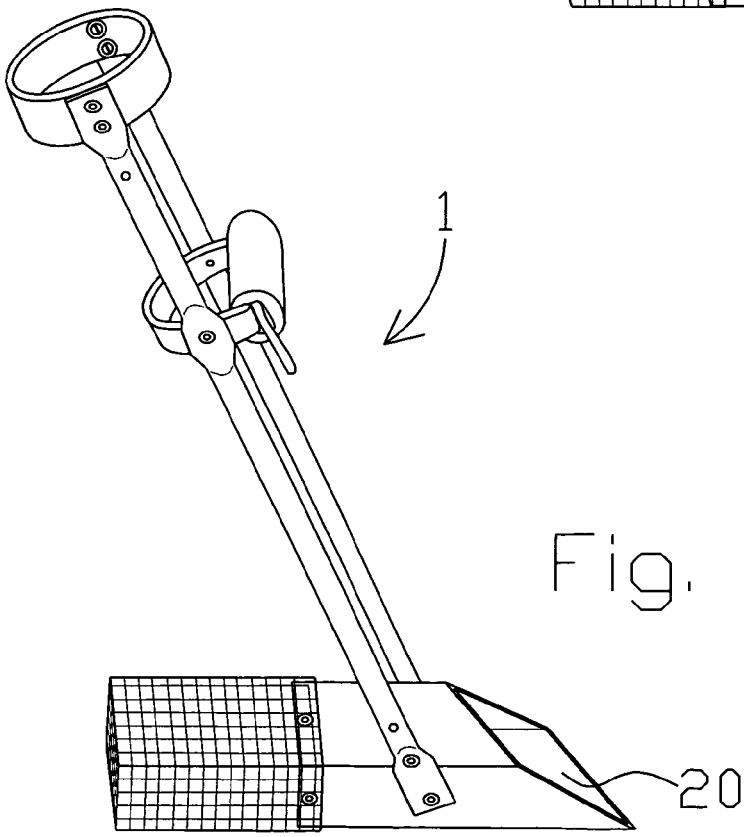
FIG. 2D is a fourth embodiment of the invention having a modified scoop member arranged in a diamond shape.
Figure 2E:
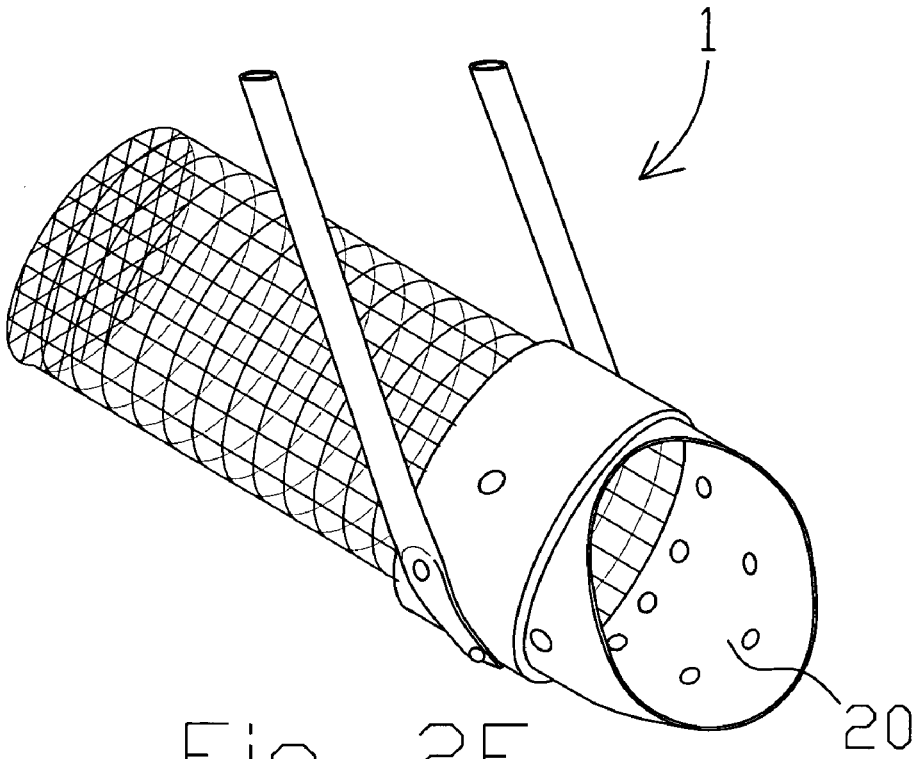
FIG. 2E is a fifth embodiment of the invention having a modified scoop member that includes an angled scoop having a rear that opens into a larger basket fastened thereat.
Figure 2F:
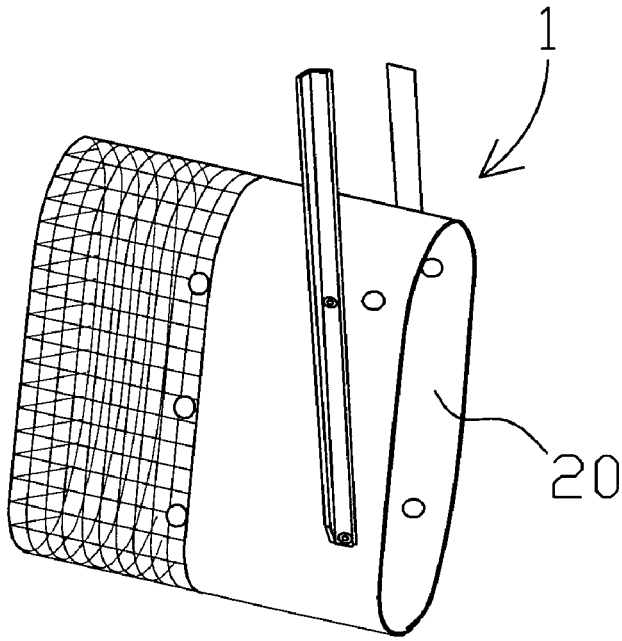
FIG. 2F is a sixth embodiment of the invention having an oval shaped scoop that includes a cutting edge formed from sheet metal such as aluminum.

A substantially hollow scoop member 20 is provided at the distal end of the handle assembly 15, and is located between, and attached to, the elongated arms. The scoop member 20 has a forward end and a rear end, a top and a bottom. As will be discussed in more detail below, the forward end of the scoop member includes an edge 21 that is designed to cut into and gather a bulk medium (such as sand) as the device is manually moved forwardly through the medium. In cross-section, the scoop member is a closed geometric shape. As shown in the figures, the cross-sectional shape of scoop member 20 is square as in FIGS. 2A-2B, but may, in modified embodiments be circular as in FIG. 2C, diamond as in FIG. 2D, oval as in FIG. 2F, or other closed geometric shape. FIG. 2E shows a scoop member 20 having an arcuate angled edge relative to the wire basket 25. By way of example, in the preferred embodiment of the invention, the scoop member is constructed of 4-½ inch square schedule 20 PVC conduit or a fence post jacket. The centerline length of the scoop top (measured between the forward end and the rear end) is shorter than the centerline length of the scoop bottom (measured between the forward end and the rear end) such that the plane of the forward end of the scoop is at an acute angle (A) relative to vertical (V). It should be noted that the scoop member 20 may be formed in any shape with any type of bend.

In the preferred embodiment of the invention, each elongated arm 15A, 15B is attached to the scoop member 20 with a pair of fasteners, which hold the elongated members 15A, 15B in a fixed position relative to the scoop member 20. Preferably, the first fastener is at a nominally higher elevation than the second fastener, and handle plane P is nominally at an acute angle (B) relative to vertical. In the preferred embodiment of the invention, one or more pairs of adjustment holes 22 is provided in scoop member for varying the nominal angle (B) between handle plane P and vertical V as can be understood when viewing FIG. 2A. It will be understood that such a configuration (i.e., angled forward end of the scoop member and angled handle plane-to-scoop bottom orientation) facilitates operation of the device in front of an operator as the device is moved forward to scoop up sand (or like media).

A closed-ended, perforated basket 25 is attached to the rear end of the scoop member 20 across the opening 23 defined at the back end of the scoop. In the preferred embodiment of the invention, the basket 25 comprises a metallic wire mesh with ½"×½" spacing such as 25 gauge hardware cloth, (approximately 0.04 inch 18 gauge wire including galvanized coating) having an aperture-to-total area of the mesh material used in constructing the sieve or basket of about 84%. That is, 16% of the basket comprises the cross wire that acts as a sieve to filter objects of interest from a medium. The basket is attached to the outside or inside of scoop member with fasteners through openings 26 arranged in the rear of the scoop 20 as shown in the various figures. In the preferred embodiment of the invention, the forward end of the basket overlaps the rear end of the scoop member by approximately 1 inch, and is attached to the scoop member with rivet fasteners. In the preferred embodiment of the invention, the cross-section of basket is substantially constant in size and shape, is the same size and shape as the cross-section of scoop member, and extends rearward from scoop member parallel to the sides of scoop member. However, in modified embodiments of the invention, the cross-sectional size of basket can increase or decrease as it extends beyond the rear of the scoop member. All seams on the wire basket is soldered or brazed to create a solid basket.

A hand grip member, collectively comprising stirrup 11 or filler piece 13, brace 8 and grip 12 is attached, using pairs of longitudinally spaced-apart fasteners, to elongated arms intermediately between the arm ring and scoop member. In the preferred embodiment of the invention, the elongated arms are approximately 32 inches long for adults, or 24 inches long for children, and the outside distance from the arm ring at the center of the hand grip is approximately 10 inches for an adult, 8 inches for a child, such that the hand grip member can be grasped by a typical operator while the arm ring encircles the operator's forearm (just below the elbow). The hand grip member preferably comprises a brace member 8, which may be constructed from a 1-inch long section of 4-inch diameter schedule 40 PVC, and is fastened axially perpendicular to the elongated arms. In the preferred embodiment of the invention, the hand grip member is in the shape of a "D" or stirrup-shape, with the flat side of the "D" being forward of the plane (P) of the elongate arms or filler piece 13. It should be noted that the overall length of the elongated arms may be longer than that mentioned above.

Figure 3A:
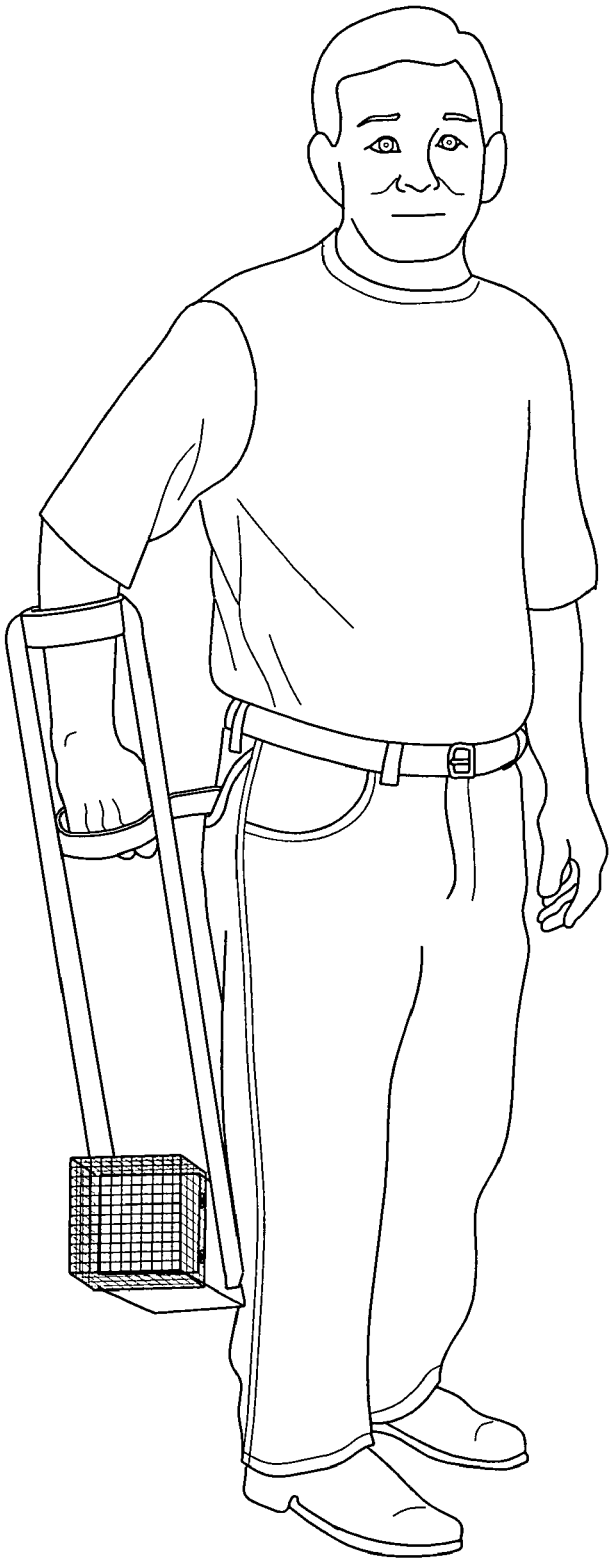
FIG. 3A shows a user depositing the notch end of the handle into a back pants pocket.
Figure 3B:
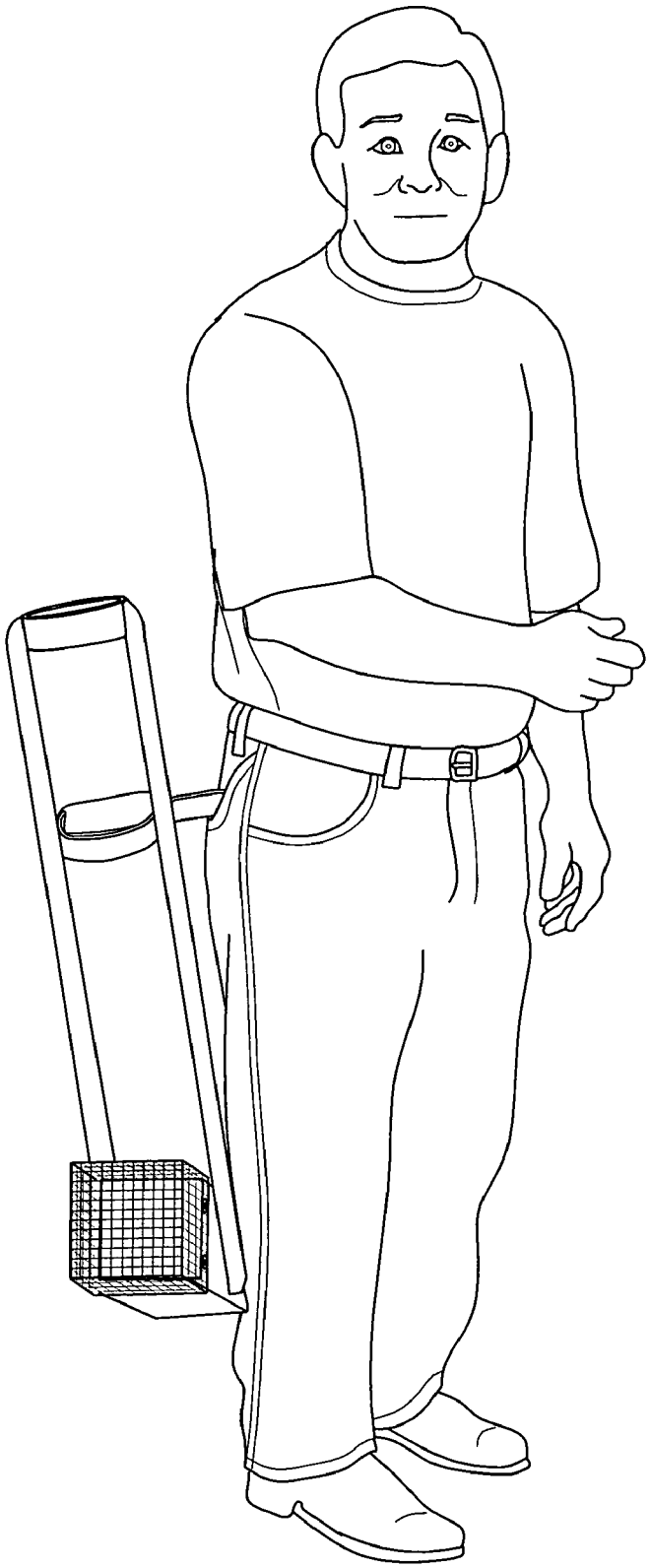
FIG. 3B shows a user having the apparatus arranged with the notch in the back pants pocket and the scooping end arranged against the lower leg.

A rigid arm or cross brace 8, preferably made of ¼-inch thick PVC, is attached to the hand grip member by common fastening means (such as adhesive, plastic weld, screws or rivets), and preferably extends approximately 1-½ to 3½ inches outward of one of the elongated arms. A notch 9 is provided, approximately ¼ to ¾ inch from the end of rigid arm 8. The notch 9 is preferably ⅛ to 3/16 inch wide by approximately ⅝ inch deep, and provides a means for securing the entire apparatus to, and carrying the apparatus by, an operator's belt or pants pocket when not in use, preferably on the back pocket out of the way when using a metal detector as shown in FIGS. 3A-3B.

A grip comprising rubber, pipe insulation, foam, or similar padding is preferably provided around at least a portion of the brace 8 for comfortable gripping of the hand grip member by an operator. Openings 16 are provided in the stirrup 11 and brace 8 to couple them together via fasteners. Stirrup 11 includes an opening 14 for passing a portion of the user's hand through during operation of the apparatus 1 or brace 8 can have alternative filler piece 13 instead of the stirrup 11.

In the preferred embodiment of the invention, the elongated arms 15A, 15B are constructed of ⅛"×¾"×¾" aluminum angle. In a modified embodiment of the invention as shown in FIG. 2B, the elongated arms 15A, 15B can be constructed of ½" electrical metallic tubing (EMT), in which case it is advantageous to totally flatten short sections 151 of the tubing to facilitate attachment of the tubing with fasteners to an arm ring and a scoop member as shown in the FIG. 2B. The tubing may be partially flattened near hand grip member. Drain openings 88 may be provided at the proximal end and distal end of the EMT to drain water and air there from when used in wet locations such as underwater or during scuba diving operations.

In operation, an operator inserts an arm through the arm ring and grasps the padded hand grip member with his hand, such that the forward end of the scoop member is facing forward of the operator. A metal detector may be arranged in the opposite hand and used to alert an operator to an area of media containing a metallic object of interest to be sifted from the media.

In a typical beachcombing operation, the (standing) operator draws the leading edge of the scoop member, through a medium that is to be sifted, in a forward and/or upward direction by moving his forearm forward and/or bending his elbow. The forward and/or upward motion of the leading edge of the scoop member causes the medium, that is to be sifted, to flow though the opening at the front of the scoop member and into the perforated basket. The apertures in the perforated basket are dimensional, located and shaped to facilitate and expedite the passage of the medium therethrough. During sifting operations, a portion of the medium is temporarily retained in scoop member and basket. An object of interest is simultaneously obstructed by the elements of the basket to impede passage of the object of interest therethrough. In this manner, the medium passes through the basket, while objects are located and separated from the medium.

It will be appreciated that the present invention is particularly useful when used in conjunction with a metal detector device. When the present invention is not in immediate use (e.g., when an operator is using a metal detector, but has not yet located a likely target portion of medium to be scooped and sifted), the apparatus can be conveniently hooked onto, and supported from, the operator's belt (or, alternatively, a pant's pocket when not in use, preferably on the back pocket out of the way when using a metal detector as shown in FIGS. 3A-3B to keep the device from interfering with a magnetic field generated by the metal detector for detecting metallic objects.

It will be appreciated from an understanding of the foregoing disclosure that the present invention provides a lightweight, ergonomic scooping and sifting device that can be operated by a person using only one arm and a hand. The interior surface of the arm ring provides a useful surface area against which the operator can apply a reactive force to counteract the coupling moment generated by the forward end of the scoop member as it passes through a granular medium. The closed geometry of the arm ring provides a useful means of generally restricting movement (and thereby facilitate easy handling) of the apparatus by the operator. The padded hand grip, being spaced apart from the arm ring provides mechanical advantage by which minimal movement of the operator's arm can cause multiplied movement of the apparatus scoop member. The apparatus is most useful when pulling the scoop towards the operator from a 2 o'clock to 8 o'clock position.

Since other modifications and changes varied to fit particular operating requirements and environments will be apparent to those skilled in the art, the invention is not considered limited to the example chosen for purposes of disclosure and covers all changes and modifications which do not constitute departures from the true spirit and scope of this invention.

With respect to the above description then, it is to be realized that the optimum dimensional relationships for the parts of the invention, to include variations in size, materials, shape, form, function and manner of operation, assembly and use, are deemed.

The length of the basket can be of different dimensions, with shorter dimensions generally being easier to move through media and longer dimensions facilitating rapid sifting of media. Preferably the basket will extend a minimum of 4 inches, but no more than 18 inches, beyond the rear end of the scoop member.

The cross brace appendages may be omitted, or it may alternatively extend to either side of the apparatus, or it may be constructed as an appendage of the brace. Various sizes, locations and shapes of the belt notch can be used, or, alternatively, the belt notch can be omitted.

A modified basket may be provided in which a rear portion of the basket angles (C) upwardly (relative to the forward portion of the basket and relative to the scoop bottom) within a range of substantially 0 to 45 degrees, in order to facilitate sifting when the forward apparatus is pulled forwardly and upwardly through a medium (i.e., sand). It has been found that increasing basket angle (C) and/or increasing handle plane angle (B) facilitates deeper scooping as opposed to shallow scooping of sand.

The forward edge of the scoop member may be beveled in order to facilitate ease of passage through the sifting medium. The bottom and sides of scoop member may be provided with perforations or apertures as shown in FIG. 2E, preferably each no larger than the perforations or apertures in the basket, in order to facilitate passage of wet sand out of the device when used for underwater scooping and sifting operation. The basket shown in FIG. 2E includes a kicked up angle such that when the bottom of the scoop is arranged parallel to the medium to be sifted, the back end of the basket extends upward several inches.

Although at preferably 45 degrees, the angle (A) between the leading edge of the scoop member and vertical can vary from 0 degrees up to 60 degrees.

Thus the scope of the invention should be determined by the appended claims and their legal equivalents, rather than by the examples given. The weight of the device typically varies in a range of between substantially 2 pounds to in excess of 4 pounds. The various elongated arm supports or handles for the basket may include angle aluminum or tubing or shapes 4A through 4H. Openings may be provided in the tubing to drain air if the device is used in an underwater setting and to also drain water when used in a dryer environment.

The elongated support arms may comprise materials selected from a group consisting of aluminum, galvanized steel, plastic, fiberglass, copper, stainless steel, polycarbonates, wood, or steel. A cross section of an elongated support member may include shapes including circles, squares, L-shapes, octagonal, hexagonal, I-beam shaped or C-channel rectangle as shown in FIGS. 4A-4H.

Figure 2G:
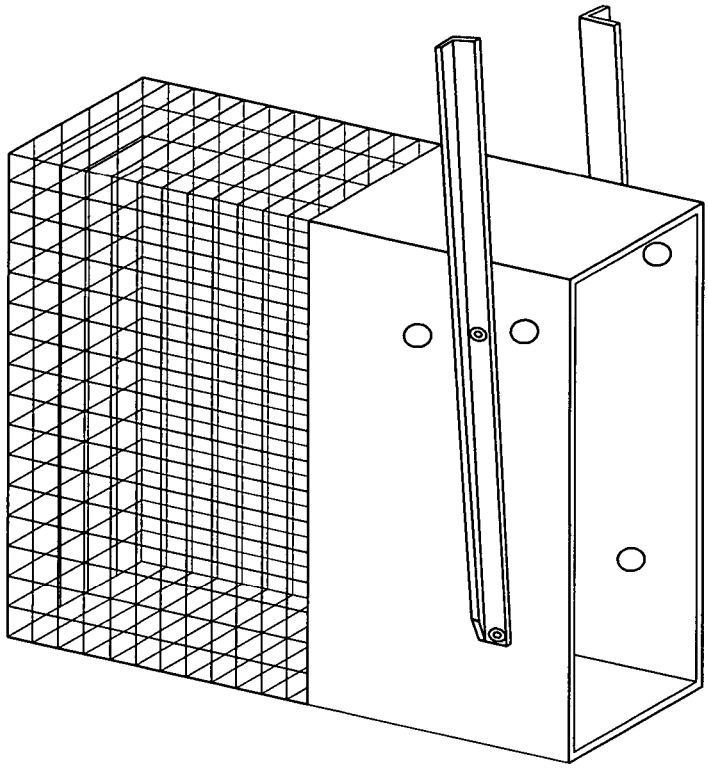
FIG. 2G is a seventh embodiment of the invention wherein the scoop member is rectangular in shape such that only a small area of medium is encountered by the lower edge reducing frictional losses and optimizing the scooping and sifting process.
Figure 2H:
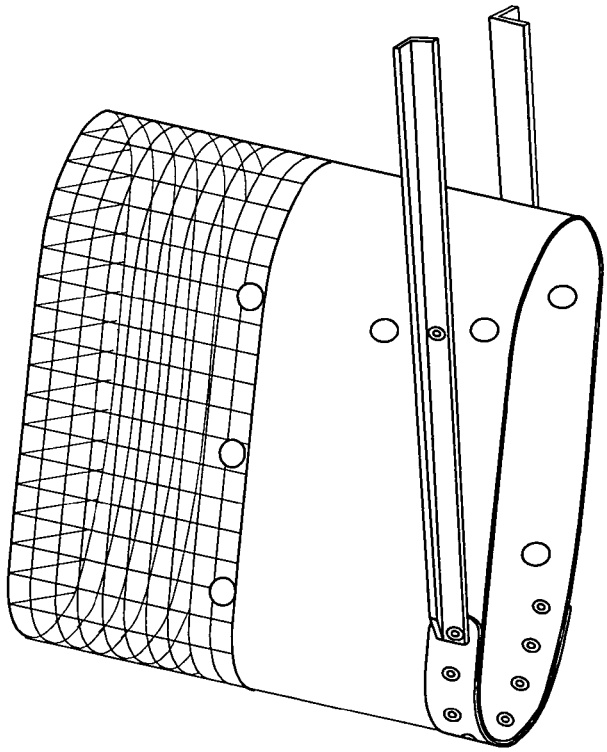
FIG. 2H is a further embodiment of the scoop having an oval shape and formed from a first material such as a formed plastic material. A metal cutting edge is provided along the bottom of this embodiment for increasing durability and longevity of the leading bottom edge of the scoop.

Referring now to FIGS. 2G and 2H which show a rectangular shaped scoop and an oval shaped scoop, respectively. The rectangular shaped scoop may further include adjustment holes 22 for coupling the scoop to the elongated arms at distinct angles relative to either the vertical plane V or horizontal plane H as defined during usage of the device with respect to that which is vertical or horizontal in relation to the device.

While the invention has been described with respect to preferred embodiments, it is intended that all matter contained in the above description or shown in the accompanying drawings shall be interpreted as illustrative and not in limiting sense. From the above disclosure of the general principles of the present invention and the preceding detailed description, those skilled in the art will readily comprehend the various modifications to which the present invention is susceptible. Therefore, the scope of the invention should be limited only by the following claims and equivalents thereof.

I claim:

1. A digger sifter with ergonomic handle comprising:

an arm and hand supported elongated handle assembly including a pair of elongated arms, said elongated handle assembly including a proximal end and a distal end;

an arm ring attached at the proximal end of the arm supported elongated handle assembly;

a scoop having a front side and a back side, said front side comprising a cutting edge, said scoop attached to the distal end of the arm supported elongated handle assembly;

a wire basket arranged against the back side of the scoop and adapted to accept a medium having an object arranged therein, said wire basket attached to the scoop at the distal end of the arm and hand supported elongated handle assembly;

a cross brace attached to the pair of parallel elongated arms intermediate the proximal and distal end of the arm and hand supported elongated handle assembly, one end of said cross brace extending outward past one of the elongated arms including a notch adapted to attach the digger sifter to an operator's belt or pant's pocket; and, a grip fastened to said cross member.

2. The digger sifter with ergonomic handle of claim 1 wherein said digger sifter is formed from a group of materials consisting of aluminum, galvanized steel, copper, stainless steel, plastics, fiberglass, thermoplastic, polycarbonate, wood, steel, metal alloys, or a combination thereof.

3. The digger sifter with ergonomic handle of claim 1 wherein a cross section shape of an elongated support arm is formed from a group consisting of a circle, a square, a rectangle, an L-shape, an octagon, a hexagon, an I-beam, or a C-channel.

4. The digger sifter with ergonomic handle of claim 1 wherein said arm ring is formed from one or more selected from a group consisting of PVC, aluminum, galvanized steel, plastics, fiberglass, copper, stainless steel, polycarbonates, wood, steel, or metal alloy.

5. The digger sifter with ergonomic handle of claim 1 wherein said parallel elongated arms are hollow and include drain openings arranged near the distal and proximal end thereof.

6. The digger sifter with a ergonomic handle of claim 1 wherein said scoop comprises two pair of holes for adjusting the angle formed between the arm supported elongated handle assembly and the scoop, wherein said scoops comprise parallel sides to the elongated arms.

7. The digger sifter with ergonomic handle of claim 1 wherein a shape of a cross section of the scoop is one or more selected from a group consisting of a square, a diamond, a circle, an oval, rectangle, oval with a V-shaped bottom, or rectangle with a V-shaped body.

8. An arm and hand supported elongated scoop handle sifter assembly comprising:

a pair of parallel elongated arms, each parallel elongated arm including a proximal end and a distal end;

a circular arm ring attached between the proximal ends of the pair of parallel elongated members;

a scoop having a cutting edge and being arranged between the distal ends of the pair of parallel elongated members;

a sifter arranged against a back side of the scoop opposite the cutting edge, said sifter accepting media that includes an object and filters the object from the media; and, a b-shaped hand grip or cross brace and filler piece attached to the pair of parallel elongated arms intermediate the cutting edge and the circular arm ring, one end of said b-shaped hand grip including a notch that is adapted to attach the arm supported elongated handle assembly to an operator's belt or rear pants pocket and being representative of the top of the b-shape such that said arm supported elongated scoop handle sifter assembly is out of a magnetic field generated by a metal detector.

9. The arm and hand supported elongated handle digger sifter assembly of claim 8 wherein said assembly is formed from a group of materials consisting of aluminum, galvanized steel, copper, stainless steel, plastic, fiberglass, thermoplastic, polycarbonate, wood, steel, metal alloys or a combination thereof.

10. The arm and hand supported elongated handle digger sifter assembly of claim 8 wherein a cross section of the elongated support member is formed from a group consisting of a circle, a square, an L-shape, an octagon, a hexagon, an I-beam, a C-channel and rectangle.

11. The arm and hand supported elongated handle digger sifter assembly of claim 8 wherein said arm ring is formed from PVC, aluminum, galvanized steel, plastics, fiberglass, copper, stainless steel, polycarbonates, wood, steel or metal alloys.

12. The arm and hand supported elongated handle digger sifter assembly of claim 8 wherein said parallel elongated members that are hollow and include drain openings arranged near the distal end and proximal end thereof.

13. The arm and hand supported elongated handle digger sifter assembly of claim 8 wherein said scoop comprises two pair of holes for adjusting the angle formed between the arm supported elongated handle assembly and the scoop having parallel sides to the elongated arms.

14. The arm and hand supported elongated handle digger sifter assembly of claim 8 wherein a shape of a cross section of the scoop is one or more selected from a group consisting of a square, a diamond, a circle, an oval, a rectangle, an oval with a V-shaped bottom and a rectangle with V-shaped bottom.

15. A digger sifter with ergonomic handle comprising:

a pair of substantially parallel supports having a first end and a second end;

an arm ring arranged substantially near the first end of the pair of substantially parallel supports;

a first pair of fasteners that fasten the arm ring between the substantially parallel supports;

a scoop having a front end and back end, said front end comprising a cutting edge;

a second pair of fasteners that fasten the scoop to the second end and between the substantially parallel supports;

a sifter arranged against the back end of the scoop via a third and fourth pair of fasteners; and, a handle having a grip arranged between the first and second ends of the substantially parallel supports, an end of said handle including a notch that sticks out past the parallel supports, said handle fastened to the substantially parallel supports via a fifth pair of fasteners.

16. The digger sifter with ergonomic handle of claim 15 wherein said digger sifter is formed from a group of materials consisting of aluminum, galvanized steel, copper, stainless steel, plastics, fiberglass, thermoplastic, polycarbonate, wood, steel, PVC, metal alloys, or a combination thereof.

17. The digger sifter with ergonomic handle of claim 15 wherein a cross section of the elongated support member is formed from a group consisting of a circle, a square, an L-shape, an octagon, a hexagon, an I-beam, rectangle, or a C-channel.

18. The digger sifter with ergonomic handle of claim 15 wherein said arm ring is formed from PVC, aluminum, galvanized steel, plastics, fiberglass, copper, stainless steel, polycarbonates, wood, steel, or metal alloys.

19. The digger sifter with ergonomic handle of claim 15 wherein said parallel elongated arms are hollow and include drain openings arranged near the first and second ends thereof.

20. The digger sifter with ergonomic handle of claim 15 wherein said scoop comprises two pair of holes for adjusting the angle formed between the arm supported elongated handle assembly and the scoop having parallel sides to the elongated members.

* * * * *